US005443266A

United States Patent [19]

Bursi

[11] Patent Number: 5,443,266

[45] Date of Patent: Aug. 22, 1995

[54] GOLF SWING PLANE TRAINING AID

[76] Inventor: Hugh A. Bursi, 4418 Nashwood La., Dallas, Tex. 75244

[21] Appl. No.: 242,616

[22] Filed: May 13, 1994

[51] Int. Cl.[6] ..... A63B 69/36

[52] U.S. Cl. ..... 273/187.2; 446/28; 446/418; 472/56; 472/133; 273/DIG. 30

[58] Field of Search ..... 273/DIG. 30, 346, 187.2, 273/189 R, 189 A; 446/28, 418; 472/56, 133; 434/252

[56] References Cited

U.S. PATENT DOCUMENTS

| | | | |
|---|---|---|---|
| 3,985,364 | 10/1976 | Brady | 273/187.2 |
| 4,058,852 | 11/1977 | Aragona | 2/115 |
| 4,239,228 | 12/1980 | Norman et al. | 273/DIG. 30 |
| 4,637,612 | 1/1987 | Wilkins | 273/187.2 |
| 4,653,582 | 3/1987 | Ehrenfried | 273/346 X |
| 4,892,317 | 1/1990 | Corder, Jr. | 273/187.2 |
| 4,960,280 | 10/1990 | Corder, Jr. | 273/189 R |
| 5,116,057 | 5/1992 | Mangiaracina | 273/187.2 |
| 5,184,827 | 2/1993 | Suttle et al. | 273/187.2 |

*Primary Examiner*—George J. Marlo

*Attorney, Agent, or Firm*—Dennis T. Griggs

[57] ABSTRACT

Sound producing tabs attached to a body strap and an arm band provide an audible signal as the sound tabs strike together during the execution of a proper down swing. The audible signal positively reinforces muscle memory that will enable the golfer to initiate the proper muscle action for a correctly executed down swing during regulation play while the training apparatus is not being used. The straps are designed to operate without restricting natural arm or body movement. The striking sound indicates to the golfer that his swing has followed the proper path on the down swing. The audible feedback signal enables the golfer to build muscle memory through proper practice with a natural, unrestricted swing as well as form a mental image to assist in the coordination of arm and body muscles so that the down swing will follow the proper inside path to the ball. Initially, there is no contact between the arm band and the body strap, with momentary striking contact occurring between the sound tabs and a feedback signal being generated only in response to correct down swing arm movement.

8 Claims, 4 Drawing Sheets

GOLF SWING PLANE TRAINING AID

FIELD OF THE INVENTION

This invention relates generally to golf training equipment, and in particular to a golf swing training aid.

BACKGROUND OF THE INVENTION

Golfers are constantly seeking to improve their swing techniques for directional control and maximum distance. One common mistake is improper arm movement during the down swing. It is not a matter of the total turn of the golfer's swing, but rather, the coiled energy or torsional force provided by the torso twist and the efficient transmission of that energy to the ball. Proper arm movement during the down swing helps the golfer to strike the ball squarely and maximize the amount of energy transferred to the golf ball.

The relationship between the trailing arm and the leading arm during the down swing is critical to obtaining the proper inside path necessary to complete a sound golf shot. Golfers have practiced maintaining a correct relationship between the golfer's trailing arm and the leading arm during the down swing so that the golfer's arms and the golf club move through a hypothetical swing plane as depicted in FIG. 1 of the drawings. The maintenance of close-to-the-body inside movement of the golfer's arms during the down swing is critical to the delivery of maximum energy to the golf ball and accurate control of the direction of flight. The natural "tilt" of the swing plane is unique for each golfer, and is a function of the golfer's body size and muscle coordination.

DESCRIPTION OF THE PRIOR ART

Golf pros and amateurs alike have practiced correct arm movement during the down swing while a coach provides feedback as to the execution of the swing. This technique is generally effective; however, the training effect is slowly achieved and requires coaching from a skilled person. In the case of the golf professional and advanced amateur, frequent repetition coupled with periodic coaching sessions produce satisfactory results. For the amateur player, who plays on occasion or only on weekends, this method of coaching and repetition is often a lengthy process in which the amateur loses interest and discontinues.

Various swing plane training devices have been proposed for using the leading arm, the trailing arm, or both as the controlling factor for creating a correct back swing in order to produce a proper down swing path or plane. Such devices rely upon a harness or mechanical fastener for restriction of arm movement, and do not allow natural arm movement during the golf swing. Other devices provide a releasable connector to prevent injury or discomfort. Some training devices produce an audible signal in response to improper or incorrect arm movement.

Such conventional training devices operate on the principle of negative feedback, and employ a feedback signal for indicating that something has been performed incorrectly, and no signal is generated in response to a marginal swing or a correctly executed swing. Because of the uncertainty associated with a silent swing (no signal), the golfer is unable to form the appropriate mental image or recognize the special muscle feeling which accompanies a correctly executed swing.

The operation of conventional golf swing training devices is based on certain assumptions and premises. First, that restriction of movement will produce muscle memory necessary for a correctly executed down swing. Second, that an audible signal will be produced if the arm movement restriction is violated. Third, that proper arm movement may be obtained by maintaining contact between the leading arm, the trailing arm, or both, and the body. And fourth, that a proper back swing will guarantee a proper down swing.

The inhibition or restriction of arm movement develops muscle memory relating to a particular back swing, down swing or follow-through movement that cannot be easily reproduced without the device. Moreover, the restriction may promote unnatural posturing which could interfere with smooth, fluid transition from back swing, down swing to follow-through. The value of muscle memory training induced by artificial movement is diminished over time, since the restriction device may not be used during regulation play. Moreover, the golfer is forced into making an artificial movement, and is inhibited from making a full and natural swing. The unnatural or artificial feel of such restricted movements leads to a loss of confidence in the golfer's ability to reproduce the artificial swing movement after the restrictive device is removed.

Additionally, conventional harnesses/restrictors often must be reset or reattached after each incorrect use, and sometimes after correct usage where the restriction limits are exceeded.

Accordingly, training apparatus is needed which will permit the golfer to practice a correct golf swing without constant coaching so that the energy stored in his torso during wind-up will be efficiently transmitted by natural arm and body movements to the golf ball during the down swing and follow-through. It will also be appreciated that such apparatus is needed for providing a positive feedback signal to the golfer which will help the golfer to anticipate by appropriate mental image and recognize the specific muscle feeling which accompanies a correctly executed natural (unrestricted) down swing.

OBJECTS OF THE INVENTION

Consequently, the general object of the present invention is to provide an improved golf swing practice device that may be used effectively without constant coaching during training sessions and during casual, unregulated play for positively reinforcing muscle memory associated with arm and body movement during the execution of a correct down swing.

Another object of the present invention is to provide a golf swing practice device that makes possible faster rates of training and improvement that may be sustained through occasional maintenance use.

Yet another object of the present invention is to provide a golf swing practice device that produces appropriate and unrestricted, natural arm and body movement that leads to a properly executed down swing.

Still another object of the present invention is to provide a golf swing practice device that may be used universally by golfers of all ages, sizes, shapes, gender, physical ability and physical disability.

Another object of the present invention is to provide a golf swing training device that utilizes natural arm and body movements to produce an audible signal when a proper down swing is executed in order to positively reinforce and develop proper muscle memory.

Yet another object of the present invention is to provide golf swing training apparatus which will positively reinforce muscle memory that will enable the golfer to initiate the proper muscle action for a correctly executed down swing during regulation play while the training apparatus is not being used.

Still another object of the present invention is to provide golf swing training apparatus which provides an audible, positive reinforcement signal during the execution of a correct down swing, and which may be used repeatedly without adjustment and has no requirement to be reset after initial set-up.

SUMMARY OF THE INVENTION

The foregoing objects are achieved according to the present invention by the use of a pair of sound producing tabs which are attached to a body belt and an arm band, respectively. The sound producing tabs, when properly positioned for striking engagement, produce an audible signal during the downswing just prior to impact of the golf club against the golf ball when the proper inside path is followed during the down swing. The sound tabs on the body strap, as well as on the arm band, are engagable in striking contact with each other during the execution of a correct down swing. The sound tabs are constructed of a material capable of producing an audible signal of sufficient volume and duration to be readily heard and also to be felt sufficiently to be usable by the hearing impaired. The sound tabs are independently securable in extended and retracted positions to accommodate beginner, intermediate and advanced skill levels.

BRIEF DESCRIPTION OF THE DRAWINGS

Referring now to the drawings in which like reference numerals indicate corresponding elements throughout the several views.

DETAILED DESCRIPTION OF THE PREFERRED EMBODIMENT

Figure 1:
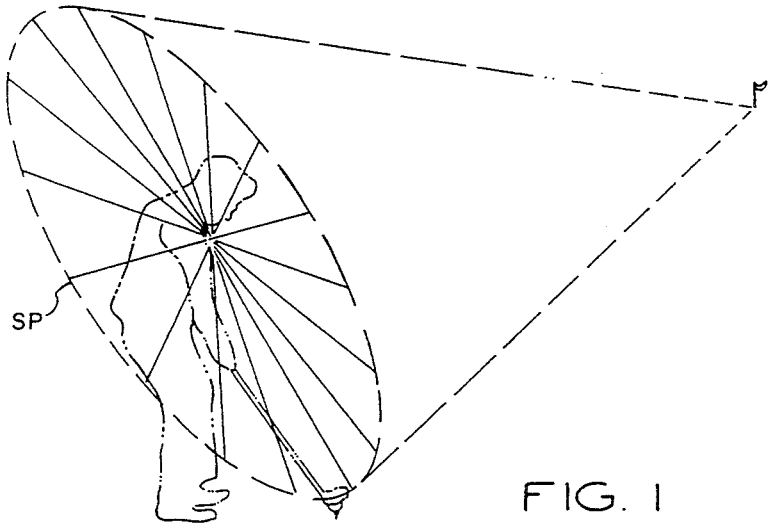
FIG. 1 is a perspective view which illustrates the execution of a golf swing through a hypothetical swing plane.

In the description which follows, like parts are marked throughout the specification and drawings with the same reference numerals, respectively. The drawing figures are not necessarily drawn to scale and the proportions of certain parts have been exaggerated for purposes of clarity.

Referring now to FIG. 1 through FIG. 5, the golf swing training apparatus of the present invention is indicated generally by the reference numeral 10. The training apparatus 10 is a sound producing training aid which employs a body strap 12 and an arm strap 14. The body strap and arm strap carry sound producing members 16, 18 in the form of rectangular tabs which are adapted to generate an audible sound in response to striking engagement of one member against the other. The straps and sound producing members are designed to function without any restriction of natural movement of the golfer's arms and body during the execution of a down swing through a swing plane SP, as shown in FIG. 1.

Figure 3:
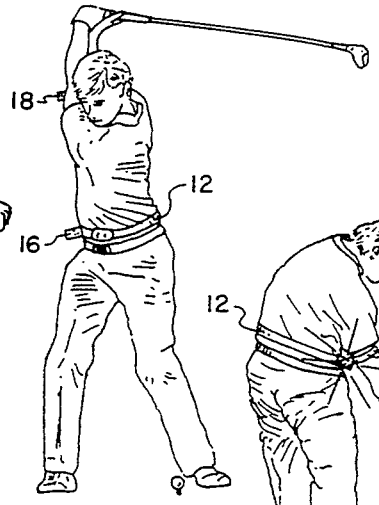
FIG. 3 is a perspective view showing the relative position of the body strap, arm band and sound tabs in the unrestricted back swing position.
Figure 4:
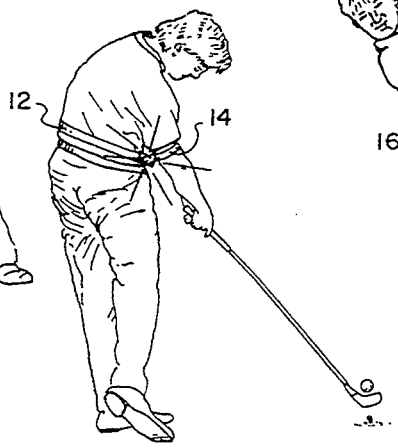
FIG. 4 is a perspective view showing the sound tabs being brought into contacting, striking engagement during the down swing.
Figure 5:
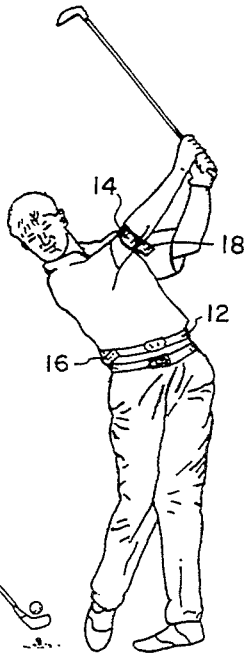
FIG. 5 is a perspective view of the unrestricted follow-through swing.

As indicated in FIG. 3, FIG. 4, and FIG. 5, the sound producing tabs 16, 18 are carried into striking contact engagement with each other during the correct execution of a down swing. Each tab is covered with a suitable sound producing material, for example a layer or patch of VELCRO hook or loop material, a wafer of hard plastic, or a wafer of metal, to create an audible signal or sound when the sound producing members come into contact with each other. The striking sound indicates to the golfer that the swing being performed has followed the proper path through the desired swing plane SP. The positive feedback signal thus promotes the development of muscle memory through proper practice with a normal, unrestricted swing as well as the development of a mental image to assist in the proper initiation of the down swing.

Figure 2:
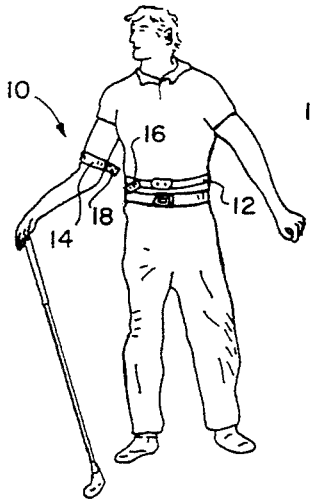
FIG. 2 is a perspective view showing proper positioning of a body strap, arm band and sound tabs.

The relationship between the golfer's trailing arm (the right arm as shown in FIG. 2) during the initial movement in the down swing is critical to attaining the proper inside path necessary to complete a sound golf shot. The sound producing members 16, 18, when properly positioned, produce an audible signal in response to striking engagement during the down swing just prior to impact as the head of the golf club turns through the desired swing plane.

The golf swing training apparatus 10 is set up in the following manner. First, the golfer secures the arm band 14 about his trailing arm (right for right-hand golfers, left for left-hand golfers). The arm band 14 is located on the upper arm just above the golfer's elbow. Proper orientation and alignment are accomplished by positioning the arm band 14 until the sound producing member 18 points toward the golfer's body. The arm band 14 is rotated until the sound producing tab 18 is directed toward the leading edge of his hip bone, as shown in FIG. 2. The sound producing member 18 should also be aligned with the edge of the elbow bone, as shown in FIG. 2.

After the arm band 14 has been correctly positioned, the golfer fastens the body strap 12 about his torso just above his waist and lines up the sound producing tab 16 with the arm band tab 18, substantially as shown in FIG. 2. The body strap 12 is adjusted until the sound producing tab 16 is aligned with the arm band sound producing tab 18, both vertically and horizontally. This initial orientation of the body strap and arm band will permit the sound producing members to strike together as the inside edge of the golfer's elbow bone is rotated in close proximity with the front edge of the golfer's hip bone. That particular orientation is consistent with rotation of the golf club through the swing plane SP, as shown in FIG. 1. The golfer then verifies that the body strap tab 16 is aligned with the arm band tab 18, both vertically and horizontally.

As shown in FIG. 3 and FIG. 4, initially there is no contact between the body strap and arm band, with momentary striking contact occurring between the sound producing tabs 16, 18 and noise being generated only in response to correct down swing arm movement through the swing plane SP. During a normal back swing, the sound producing tabs 16, 18 are widely separated with respect to each other. During the initiation of the down swing, the golfer is instructed to move his trailing arm in such manner that the sound producing tabs 16, 18 are brought into striking contact engagement as the golf club initially touches the ball. The noise generated by striking engagement of the sound producing tabs creates a positive reinforcement signal which indicates to the golfer that he has correctly executed the down swing through the swing plane SP. In FIG. 5, the sound producing members are widely separated again, as the golfer executes the follow-through swing.

Figure 6:
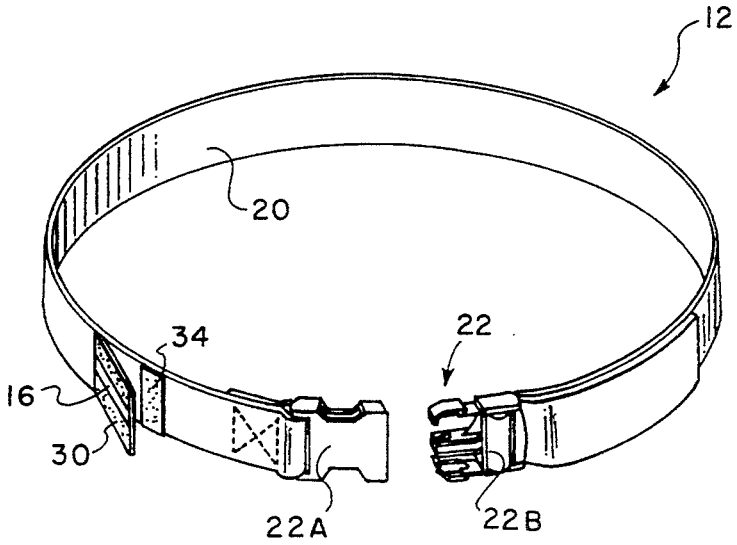
FIG. 6 is a perspective view of the body strap with sound tab attached in the released, extended position.

Referring now to FIG. 6, the body strap 12 has a main body portion 20 which is sized appropriately for encircling the torso of the golfer. The main body portion 20 is preferably made of non-elastic material such as nylon webbing. The ends of the body strap 12 are releasably coupled together by a releasable bayonet buckle assembly 22, which includes a female latch receiver 22A and a releasable male bayonet latch connector 22B. Other body strap fastener arrangements, for example a conventional belt buckle, may be used to good advantage. The sound producing tab 16 is attached to the main strap body portion 20 by stitching. Alternatively, the sound producing tab 16 is formed by folded strap sections 20A, 20B of the main body strap 20. The strap sections 20A, 20B are preferably stitched together so that the sound producing tab 16 projects radially outwardly with respect to the main body strap 20, as shown in FIG. 9.

Figure 7:
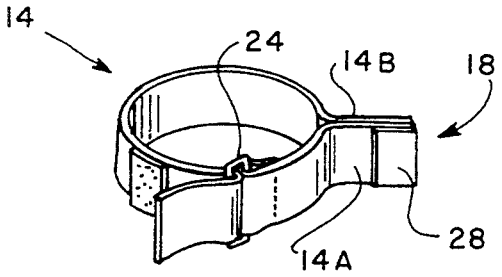
FIG. 7 is a perspective view of the arm band showing the sound tab in the released, extended position.
Figure 8:
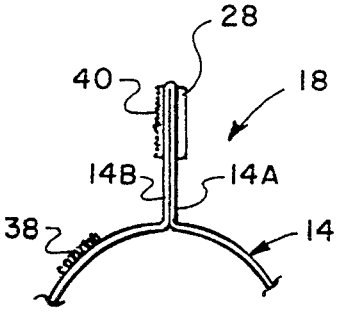
FIG. 8 is a top plan view, partially broken away, of the arm band shown in FIG. 7.

The arm band 14 has a construction similar to that of the body strap. Preferably, the sound producing tab 18 is formed by strap sections 14, 14A which are folded and stitched together, so that the sound producing tab 18 projects radially from the arm strap 14 as shown in FIG. 7 and FIG. 8. The opposite ends of the arm strap 14 are adjustably secured together by a D-ring fastener 24.

Figure 9:
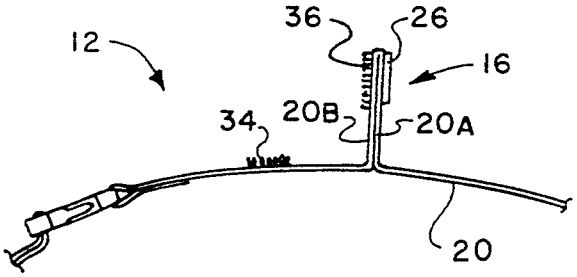
FIG. 9 is a top plan view, partially broken away, of the body strap shown in FIG. 6.

Referring now to FIG. 8 and FIG. 9, the first and second sound producing members 16, 18 include first and second striker plates 26, 28, respectively. In this embodiment, the striker plates are constructed of a material capable of producing an audible signal in response to striking or rubbing engagement with each other, for example a wafer of hard plastic or a thin metal sheet of aluminum or copper. According to an alternative embodiment, the striker pads are constructed of hook and loop fabric patches 30, 32 as shown in FIG. 14, FIG. 15, FIG. 16 and FIG. 17. The hook and loop fastener patches 30, 32 are secured to the projecting tabs 16, 18 by stitching. The hard striker pads 26, 28 of FIGS. 1–13 are secured to the tabs 16, 18, respectively, by an adhesive deposit.

Figure 10:
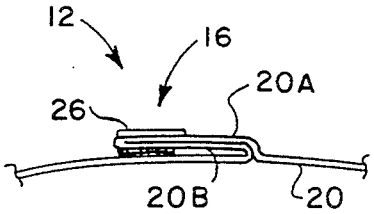
FIG. 10 is a top plan view, partially broken away, of the body strap, showing the sound tab in the retracted, minimum profile position.
Figure 13:
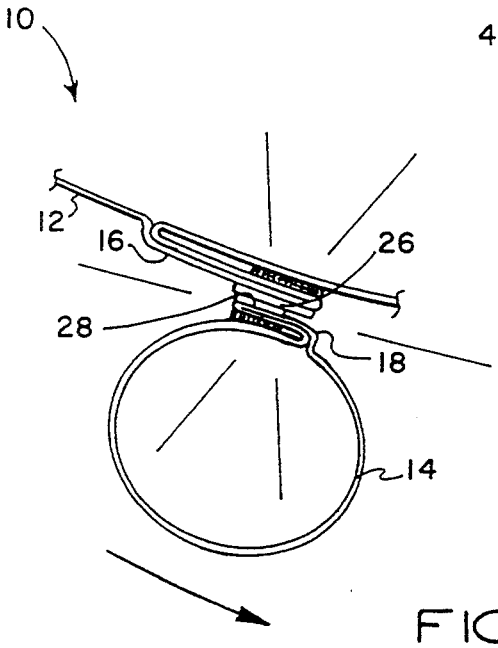
FIG. 13 is a view similar to FIG. 12 in which both sound tabs are retracted and secured in the minimum profile positions for use at the advanced skill level.

The sound producing tabs 16, 18 are independently securable in extended and retracted positions for accommodating beginner, intermediate and advanced skill levels. The radially extended positions of the sound producing tabs 16, 18 are illustrated in FIG. 8 and FIG. 9. The minimum profile, retracted positions of the sound producing tabs 16, 18 are shown in FIG. 10 and FIG. 13. Referring to FIG. 10 and FIG. 13, the sound producing tab 16 is retained in the retracted, minimum profile position against the body strap 20 by hook and loop fastener patches 34, 36 which are secured to the body strap 20 and tab 16, respectively, as shown in FIG. 9. Mutually engagable hook and loop fastener members 38, 40 are secured to the arm band 14 and sound producing tab 18 for the same purpose, as shown in FIG. 8.

Figure 11:
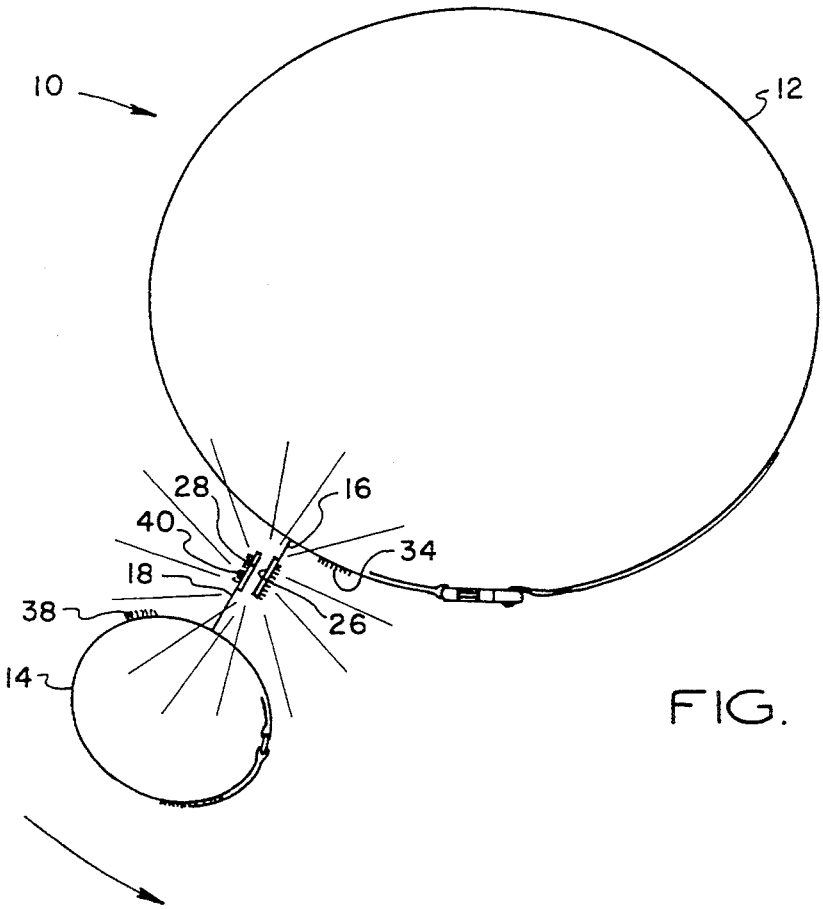
FIG. 11 is a top plan view showing the relative position of the body strap and arm strap, with both sound tabs fully extended for striking engagement for use at the beginner skill level.

When the golf swing training apparatus 10 is set up for use by a golfer having beginner skill level, both sound producing tabs 16, 18 are released and extended to the regularly projecting positions as shown in FIG. 11. In that arrangement, the golfer's arm is abducted relative to the golfer's torso, and striking engagement is made by the fully extended sound tabs 16, 18.

Figure 12:
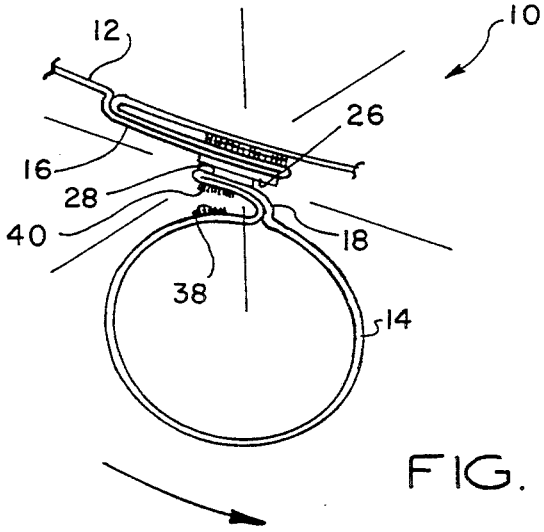
FIG. 12 is a view similar to FIG. 11, with the sound tab of the body strap being retracted and secured in the low profile position for striking engagement by the fully extended sound tab of the arm strap, for use at the intermediate skill level.

In the arrangement shown in FIG. 12, the golf swing training apparatus is set up for use by a golfer having intermediate skill level. In this configuration, the sound producing tab 16 on the body strap is retracted and secured in its low profile position, and the sound producing tab 18 carried by the arm band 14 is fully extended and projects radially so that its striker pad 28 is positioned for striking engagement against the striker pad 26.

For advanced players, the configuration of FIG. 13 is utilized. In that arrangement, both sound tabs 16, 18 are folded over and secured in their minimum profile positions by the hook and loop fasteners 34, 36 and 38, 40, respectively.

Figure 14:
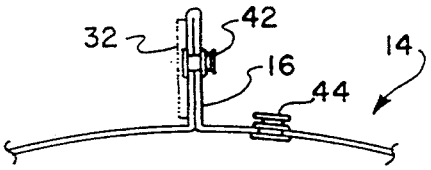
FIG. 14 is a top plan view of the body strap assembly, partially broken away, which illustrates a snap fastener for securing the sound tab in the retracted, minimum profile position.
Figure 15:
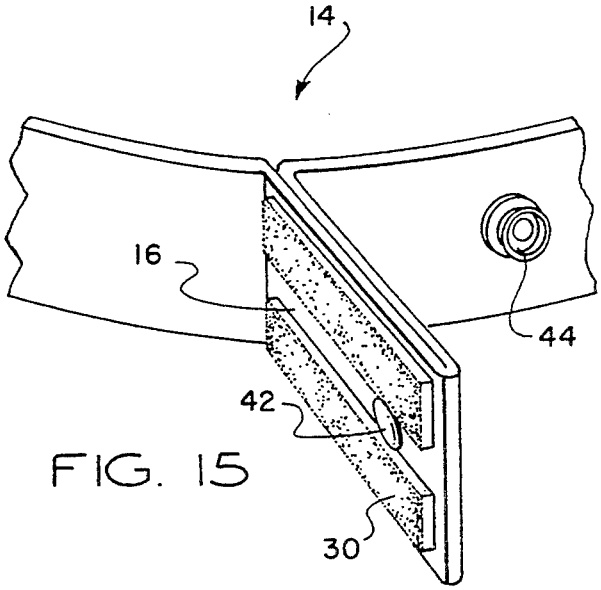
FIG. 15 is a perspective view, partially broken away, of the body strap and sound tab embodiment shown in FIG. 14.
Figure 16:
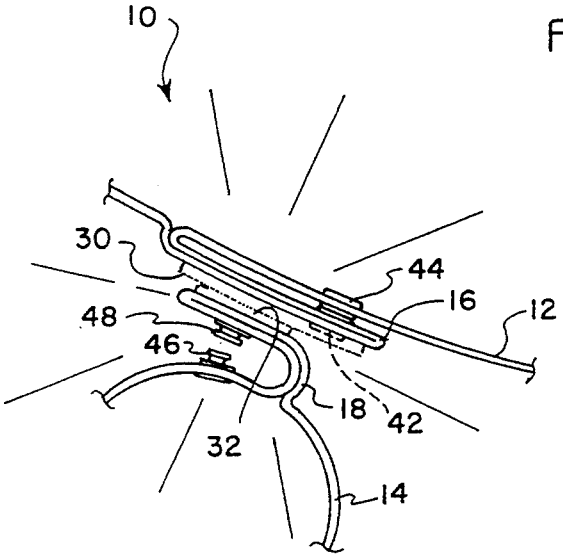
FIG. 16 is a top plan view which illustrates the intermediate skill level in which the sound tab of the body strap is secured by the snap fastener in the minimum profile position; and, FIG. 17 is a top plan view, partially broken away, showing an alternative sound tab embodiment in which the audible signal is generated by striking engagement between hook and loop fastener members.
Figure 17:
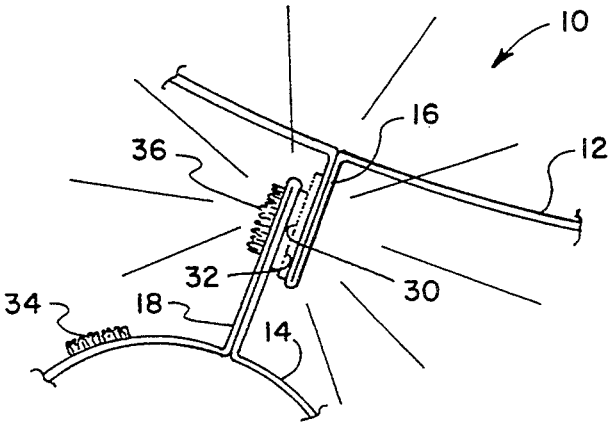

Referring to FIG. 14, FIG. 15 and FIG. 16, the sound tab 16 is securable to the fully retracted, minimum profile position by mutual engagable male and female snap members 42, 44. A similar snap fastener assembly of male and female snap members 46, 48 is attached to the arm band and sound tab 18, respectively, for securing the sound tab 18 in its fully retracted, minimum profile position (corresponding with the position shown in FIG. 13).

In the fully retracted, minimum profile positions, the sound tabs produce an audible noise as a result of striking engagement and frictional rubbing engagement with each other. Mechanical vibrations are also generated which are conducted through the arm band and through the body strap, which may be sensed by the golfer, and may be relied upon as a positive feedback indicating signal for the hearing impaired.

The predetermined proximity relation of the first sound tab relative to the second sound tab is established when the leading edge of the golfer's elbow bone is rotated in close proximity to the front edge of the golfer's hip bone, substantially as shown in FIG. 4. The closeness of the golfer's arm relative to his hip is thus limited by the combined radial projections of the sound generating members 16, 18. Maximum energy is delivered to the golf ball squarely along the intended line of flight when the golfer's arms and the golf club are swung through the preferred swing plane SP. Striking engagement between the sound producing members 16, 18, in one of the beginner, intermediate or advanced configurations, informs the golfer that he has correctly executed the down swing through the preferred swing plane.

It will be appreciated that the golf training apparatus 10 may be used by the golfer to practice a correct golf swing without a coach, and while employing only natural arm and body movements. That is, the sound indicates to the golfer that the swing he has just performed has followed the preferred path on the down swing. This allows the golfer to build muscle memory in connection with normal, unrestricted swings, and also promotes the development of the appropriate mental imagery which will assist in the proper initiation of the down swing. Because of its simplicity, the golf swing training apparatus 10 may be used during training sessions as well as during casual, unregulated play. Moreover, the skill level may be sustained or improved through occasional maintenance use. Although use of the training apparatus 10 with a golf club is preferred, the training apparatus 10 may be used for swing practice without a golf club. The training apparatus 10 may be used repeatedly without adjustment and has no requirement to be reset after the initial set-up.

What is claimed is:

1. A method for training a golfer to maintain correct arm and body movement during the execution of a proper down swing comprising the steps:

moving a first signal generating means coupled to an arm of a golfer relative to a second signal generating means coupled to the torso of the golfer whereby a predetermined proximity relationship is established between the first and second signal generating means during the execution of a down swing; and, generating a signal which may be perceived by the golfer when the predetermined proximity relationship is established.

2. A golf swing training method as defined in claim 1, wherein the predetermined proximity relationship is produced by striking engagement of the first signal generating means against the second signal generating means.

3. The golf swing training method as defined in claim 1, wherein the predetermined proximity relationship is established by producing frictional, rubbing engagement between the first and second signal generating means.

4. A golf swing training method as defined in claim 1, wherein the predetermined proximity relationship is established by frictional rubbing engagement between the first and second signal generating means, including the step of conducting mechanical vibration through an arm band coupled to the golfer's arm or a body strap coupled to the golfer's torso.

5. A method for detecting the execution of a golf down swing comprising the steps:

moving a first sound tab coupled to the golfer's trailing arm into striking engagement with a second sound tab coupled to the torso of the golfer as the trailing arm rotates through a down swing.

6. A method for detecting the execution of a golf down stroke as defined in claim 5, including the steps:

supporting one of the sound tabs in radially spaced, projecting relation with respect to the golfer; and, swinging the golfer's trailing arm in abducted relation to the golfer's torso while producing striking engagement between the first and second sound tabs in the space between the golfer's arm and torso.

7. A method for detecting the execution of a golf down stroke as defined in claim 5, including the steps:

securing both sound tabs in a retracted, minimum profile position against a body strap coupled to the golfer's torso and an arm strap coupled to the golfer's arm, respectively, and, generating an audible signal by rubbing engagement of one sound tab against the other during the execution of the down swing.

8. A method for detecting the execution of a golf down stroke as defined in claim 5, including the steps:

extending both sound tabs in radially projecting extended positions with respect to a body strap coupled to the golfer's torso and arm strap coupled to the golfer's trailing arm, respectively; and, producing striking engagement of the radially projecting sound tabs as the golfer's arms rotate through the down swing.

* * * * *